United States Patent [19]

Trahan et al.

[11] Patent Number: 5,005,503

[45] Date of Patent: Apr. 9, 1991

[54] BROKEN YARN DETECTOR FOR MULTIPLE YARN MANIPULATING MACHINES

[75] Inventors: Alain Trahan, Wickham; Paul-André Grondin, Acton Vale; Luc Bilodeau, Drummond Ville, all of Canada

[73] Assignee: Peerless Carpet Corporation, Quebec, Canada

[21] Appl. No.: 449,555

[22] Filed: Dec. 12, 1989

[51] Int. Cl.[5] ..... D05B 69/36; B65H 63/024

[52] U.S. Cl. ..... 112/277; 66/163; 139/353

[58] Field of Search ..... 139/353, 357, 358; 112/278, 277; 66/163; 19/0.22, 0.25; 28/187

[56] References Cited

U.S. PATENT DOCUMENTS

| | | | |
|---|---|---|---|
| 2,734,362 | 3/1953 | Schick | 66/163 |
| 3,529,560 | 1/1969 | Jackson | 112/273 X |
| 3,687,095 | 8/1972 | Jackson | 112/80.18 |
| 3,764,773 | 10/1973 | Merkle | 66/163 X |
| 4,372,346 | 2/1983 | Hutter | 28/187 X |
| 4,522,139 | 6/1985 | Beverly | 112/273 |
| 4,791,967 | 12/1988 | Vandeweghe et al. | 66/163 X |

FOREIGN PATENT DOCUMENTS

| | | | |
|---|---|---|---|
| 374189 | 6/1907 | France | 139/353 |

*Primary Examiner*—Werner H. Schroeder
*Assistant Examiner*—Paul C. Lewis
*Attorney, Agent, or Firm*—Alan Ruderman

[57] ABSTRACT

A textile machine having a multiplicity of yarn manipulating instrumentalities includes a yarn break detector. The specific machine disclosed is a tufting machine having a multiplicity of reciprocable needles threaded with respective yarns supplied from a source and the yarn break detector includes at least one metal washer carried by a respective yarn between the needles and the source. The washers are mounted above a trough having first and second spaced apart strips of electrical conducting members formed in a Vee configuration having a small gap between the plates at the lower apex of the Vee. The plates are connected in an electrical circuit which is maintained open by the gap until a yarn is broken and the washer carried thereon drops into the trough to short the plates together and close the circuit. The circuit includes a relay which energizes an indicator light and deenergizes the tufting machine motor when a yarn is broken. A series of such detectors may be mounted laterally adjacent each other beneath the yarns to provide an indication of the location where the broken yarn occurred by means of an indicator light associated with each detector.

18 Claims, 2 Drawing Sheets

BROKEN YARN DETECTOR FOR MULTIPLE YARN MANIPULATING MACHINES

BACKGROUND OF THE INVENTION

This invention relates to textile machines such as tufting machines or the like which utilize multiple yarn ends, and more particularly to a broken yarn end detector device for such machines for providing a signal when a yarn end is broken, and for stopping the machine upon such occurrence.

In machines which manipulate or utilize a multiplicity of yarn ends or strands which are fed to yarn manipulating instrumentalities, it is common for a yarn to break due to excessive tension, frictional rubbing or defects in the yarn itself. Machines of this type include tufting machines, looms, knitting machines and the like. For example, in a tufting machine where more than 1,000 needles each carrying an individual yarn is employed for penetrating a backing material to insert loops of yarn therein, when a yarn fed to a particular needle breaks, stitches are no longer formed by that needle. Knitting stitches likewise cease for a particular needle when the yarn fed to that needle breaks, and similarly if a warp or filling yarn breaks while being fed to a loom interlacing of that yarn terminates and the weave is defective.

Yarn break detectors and stop motion devices for various yarn manipulating textile machines are known in the prior art. Most of these devices utilize complicated electro-mechanical means requiring delicate positioning or adjusting which lose their sensitivity in the high lint environment of the yarn manipulating machines. Thus, they are not only difficult to adjust, but also to maintain. Prior art devices of this type include Jackson U.S. Pat. No. 3,529,560 which requires a drop wire to slide down an electrode bar which is insulated from the drop wire to engage an electrode. In Merkle U.S. Pat. No. 3,764,773 a drop wire is supported on the yarn which is carried through eyelets in a pivotable electro-magnetically controlled lever, the drop wire falling when the yarn is broken to open the circuit to the electromagnet and close a circuit to stop the machine. In other known prior art, a light beam is disposed across the machine from a transmitter to a receiver and when the beam is broken a circuit is activated to shut the machine. For example, in Jackson U.S. Pat. No. 3,687,095 a light beam is positioned so that when a yarn breaks the yarn drops into the path of the light beam to activate the circuit. In operation, however, particularly in the tufting art, the light beam is offset from the plane of the yarns and when the yarn breaks it may not fall into the path of the light beam but fall on top of another yarn, especially in high speed machines and in those machines having close gauge where the yarns are disposed closely adjacent each other. When this occurs, the broken yarn may even be pulled along by an adjacent yarn and not be noticed until a substantial amount of defective fabric has been produced. Thus, the unreliability of this arrangement has resulted in minimal use or in its non-use.

An improvement to these prior art devices is that disclosed in Beverly U.S. Pat. No. 4,522,139 in which a series of fingers are held in a raised position by respective yarns and when a yarn breaks, the finger drops into the path of the light beam to activate circuitry to stop the machine. However, because of the need for the light beam the fingers should be placed close to the needles so that the light transmitting and receiving means may be supported on a rigid portion of the machine, and thus if a yarn breaks the needle associated with that yarn almost immediately stops stitching. However, in high speed machines this can happen quickly before the circuitry is activated. Moreover, in certain tufting machines the yarn is trained about a substantial number of feed rollers and guides so that a substantial amount of tension is placed on the yarn between the rollers or guides and the needles, and thus if a yarn break occurs substantially upstream of the rollers or guides, i.e., between the creel or beam, the broken yarn will not be detected until the end of the broken strand is relatively close to the fingers.

It is therefore highly desirable to have a reliable yarn break detecting device which is not affected by the speed of the machine which can be placed a substantial distance from the needles or other yarn manipulating instrumentalities to detect a break upstream therefrom and which may be utilized by itself or in conjunction with apparatus such as that disclosed in the aforesaid Beverly patent to provide a substantially 100 percent reliable broken yarn detection system minimizing the production of defective fabric.

SUMMARY OF THE INVENTION

Consequently, it is a primary object of the present invention to provide a simple yarn detecting device which may be placed upstream of the yarn manipulating instrumentalities such as adjacent a thread guide or the like, which device is not affected by the speed of operation of the machine with which it is utilized and which is highly reliable.

It is another object of the present invention to provide in a yarn manipulating machine broken yarn detecting apparatus for reliably detecting broken yarn ends, the apparatus including a pair of spaced apart electrical contacts disposed beneath a yarn supported drop member which falls by gravity when a yarn supported thereby is broken, the contacts being arranged so that the drop member closes the circuit in which the contacts are connected.

It is a further object of the present invention to provide a reliable broken yarn end detector for providing a signal to a monitor and stop the yarn manipulating machine with which it is used in response to a broken yarn, the apparatus having at least one electrical conducting washer member supported by each yarn above a pair of electrical conducting metallic strips spaced apart but spaced closely together beneath the washer members and arranged so that when a washer member drops it will engage both strips to close an electrical circuit in which the strips are connected and which is normally open due to the spacing between the strips.

Accordingly, the present invention provides apparatus for a yarn manipulating machine having a multiplicity of yarn engaging members supported by respective yarn ends or stands between a yarn supply and the yarn manipulating instrumentalities of the machine, the members being electrically conductive and being disposed above a support having first and second strips of electrical conducting members mounted adjacent each other but spaced apart by a small gap connected in a circuit which is normally maintained open by the gap, the contact strips being disposed beneath the yarn engaging members so that when a yarn end breaks the member will fall and engage both contact strips to close the circuit. The circuit includes means for shutting the machine and signal means to indicate the vicinity of the broken yarn. In the preferred form of the invention the contact members are mounted at an inclination to each other in a trough disposed beneath the washer members, the gap between the contact members being at the bottom of the trough so when a washer member falls it drops into the bottom of the trough to engage and make contact with both contact strips to close the electrical circuit.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
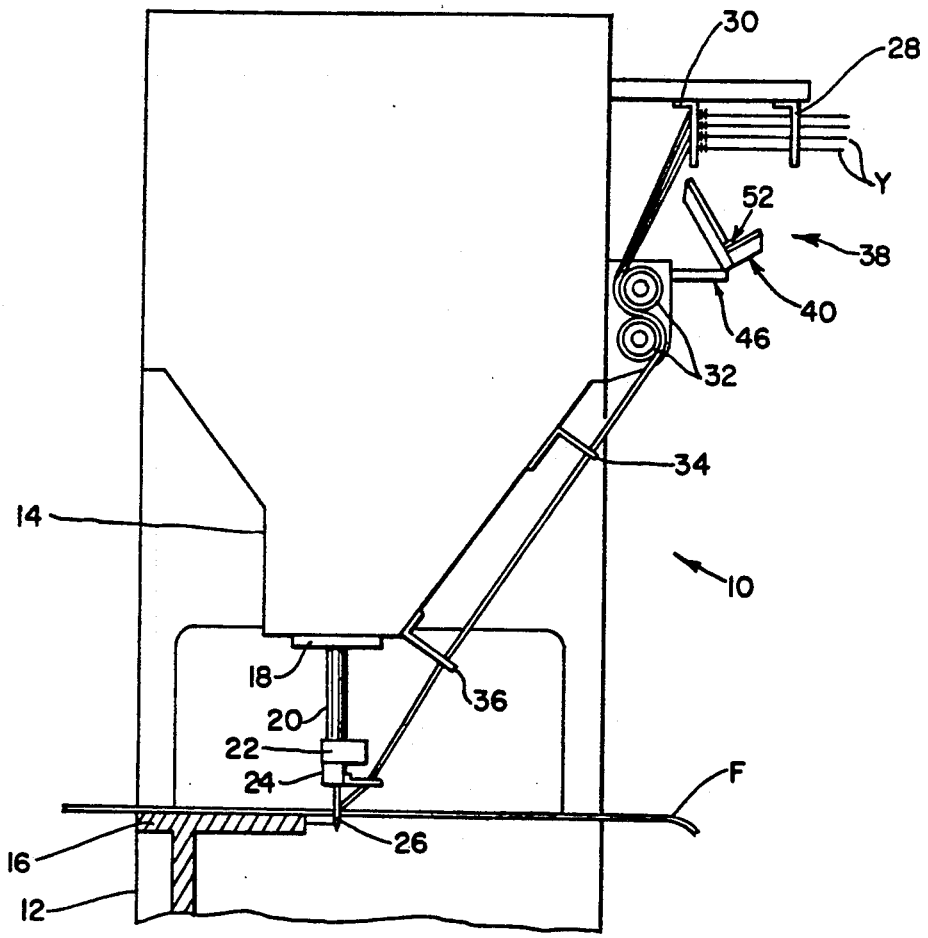
FIG. 1 is an end elevational of a portion of a tufting machine incorporating apparatus constructed in accordance with the principles of the present invention during normal operation of the machine.
Figure 2:
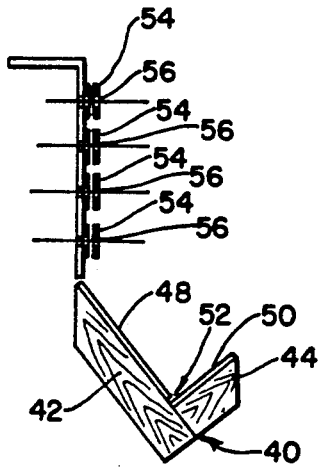
FIG. 2 is a diagrammatic view of the apparatus illustrated in FIG. 1 enlarged relatively thereto.

The invention is depicted in the drawings in the environment of a tufting machine although it should be clear that the invention may be utilized in conjunction with any multiple yarn manipulating machine such as a knitting machine, a loom or the like. Referring now to the drawings, and particularly to FIG. 1, there is illustrated a conventional tufting machine 10 having a frame comprising a bed 12 and a head 14 disposed above the bed. The bed 12 includes a bed plate 16 across which a backing fabric F is adapted to be fed by conventional feed means (not illustrated).

Mounted in the head 14 are a plurality of collars 18 (only one of which is illustrated) within which a respective push rod 20 is reciprocably driven in conventional manner. The lower ends of the push rods are connected to a needle holder 22 which carries a needle bar 24 that in turn carries a multiplicity of needles 26 which are reciprocably driven to penetrate the backing fabric F to insert loops of yarn therein which are seized by looper means (not illustrated) in conventional manner. Yarn Y is fed conventionally from a creel (not illustrated) to yarn guides 28, 30 directed to feed rollers or the like 32 for feeding the yarn through additional yarn guides 34, 36 to the respective needles. Since the tufting machine is conventional, further description thereof is not deemed necessary for a full understanding of the present invention.

In a typical tufting machine there are upward of 1,000 needles while in very fine gauge machines the number of needles may approximate 2,000. Similarly, in knitting machines and in looms there are also a multiplicity of yarn manipulating instrumentalities. Thus, it is difficult, if not impossible, to visually determine when a yarn end breaks so that the corresponding yarn manipulating instrumentality is not functionally acting on the yarn as required. In high speed machinery a large amount of defective fabric may result when a yarn break occurs, and when the gauge is extremely small, large defects are difficult to repair, resulting in substantial amounts of scrap fabric. Obviously, the quicker the yarn break can be detected, the smaller the amount of defective fabric produced and the easier it is for the defect to be repaired.

The present invention provides a broken yarn detector 38 that can be readily mounted on or adjacent the machine for detecting when a broken yarn end occurs and to provide a signal which may be used to automatically stop the operation of the machine. By placing the detector 38 in advance of the yarn manipulating instrumentalities, i.e., the needles, a yarn break may be determined long before a defect may result in the fabric being produced. This is particularly true, when the yarn break detector of the present invention is utilized in conjunction with a broken yarn detector such as that illustrated in the aforesaid Beverly U.S. Pat. No. 4,522,139, which may be mounted closely adjacent the needles. Thus, if a break in the yarn occurs adjacent the needles the detector in the aforesaid patent will be activated to stop the machine, but if a break occurs somewhere between the yarn supplying creel or the like and a tension supplying member such as the feed rollers 32, the simple yarn detector 38 of the present invention will detect the broken yarn and stop the machine prior to the feed rollers so that the yarn may be repaired prior to substantially any defective fabric being produced.

In accordance with the present invention, the yarn break detector 38 comprises an elongated electrically insulated frame 40 defining a trough or the like having downwardly sloping walls 42, 44 forming a substantially V-shaped depression or recess at the junction between the upper surfaces of the walls 42, 44, the frame 40 being disposed below the yarns Y at the location where the broken yarns are to be detected. The frame is secured in this location by securing it by bracket means 46 either directly or indirectly to the tufting machine. The walls 42, 44 may be formed from wood or other relatively inexpensive electrical insulating material readily connected together or may be formed from substantially any material including metal if the upper surfaces of the walls 42, 44 are lined or coated with an electrical insulating material. In the preferred embodiment the frame 40 is wood and thus the walls 42 and 44 are butt joined together at a substantially 90° angle. Disposed on the upper surface of the walls 42, 44 is a respective electrically conductive elongated strip of material 48, 50, this material preferably being a metal such as stainless steel. The strips 48, 50 are secured to the insulated walls 42, 44 by countersunk screws or the like and disposed so that a small gap 52 exists between the strips at the junction of the upper surfaces of the walls 42, 44. The gap 52, for reasons hereinafter disclosed, preferably may be in the order of approximately 1/32 of an inch. If a conductive material having an insulated lining or coating is used for the walls of the frame 40, then metallic screws cannot be used to mount the strips 48, 50 if they would extend into the metal walls of the frame 40, but an insulated connector should be used, such as an epoxy resin adhesive or the like.

Figure 3:
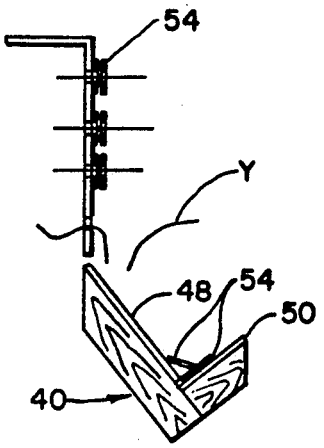
FIG. 3 is a view similar to FIG. 2 illustrating a position of a washer after the yarn on which it is supported has broken.

Disposed above the frame 40 where the yarn break is to be detected, and preferably adjacent to a yarn guide such as the guide 30, is a plurality of electrically conductive members 54 each having a yarn receiving aperture 56. Preferably these members 54 are annular metallic discs such as conventional washers having a thickness equal to or greater than the gap 52. The washers are arranged such that at least one and preferably two washers are disposed about each yarn strand, i.e., each yarn strand passes through at least one washer. The disposition of the washers relative to the frame 40 is such that when a yarn strand breaks the washer or washers associated with that strand will fall and engage the strip 48 on the sloped wall 42. Thus, when the yarn strands are whole, i.e., unbroken, the yarns will support the washers, the tension in the yarn strands maintaining the washers substantially in their initial disposition adjacent the yarn guide 30. However, when the yarn strand breaks, the washer or washers associated therewith will no longer be supported by the strand and will fall onto the strip 48 and slide downwardly by gravitational action toward the gap 52. When the washer or washers associated with the broken yarn reach the gap 52 they will engage not only the conductive strip 48, but also the conductive strip 50 thereby providing an electrically conductive path between the strips 48 and 50 as illustrated in FIG. 3.

By sizing the thickness of the washers and the gap such that the washers are at least equal in thickness to the space between the gap 52, the precise disposition of the washers after falling will not affect the action of the detectors since in any disposition an electrical path will be provided between the strips 48, the washers 54 and the strip 50. Since conventional relatively inexpensive washers are obtainable in the order of 1/32 of an inch, the gap 52, as aforesaid, is preferably of this dimension. In FIG. 3, two possible dispositions of fallen washers are depicted, each washer acting to close the gap between the strips 48 and 50 below the broken yarn. Thus, by providing the strips 48 and 50 in a simple electrical circuit which is normally open because of the gap 52, an electrical signal can be provided when a washer falls to close the gap thereby closing the circuit. The fallen washer or washers thus act as a circuit closing switch to provide an electrical path between the strips 48 and 50.

Figure 5:
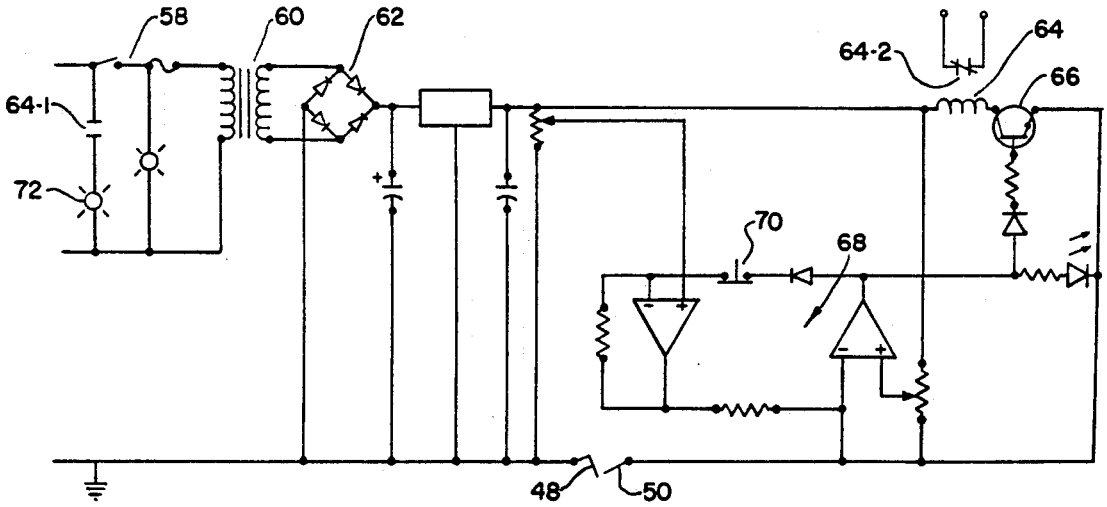
FIG. 5 is an electrical schematic of circuitry utilized in conjunction with the apparatus for providing a signal and for stopping the machine.

A simple electrical circuit for providing a signal and for shutting the motor of the machine to thereby stop the machine to permit the broken yarn to be repaired is illustrated in FIG. 5. Electrical energy is supplied to the circuit from a conventional source through an on/off switch 58 and the voltage is stepped down at transformer 60 to approximately 18 volts and rectified at the bridge rectifier 62. The coil of a conventional relay 64 such as a Potter and Brumfield 10SE1-Y2 is connected through a transistor 66 which is driven through the operational amplifier circuit 68 and which holds the transistor 66 in the low or off condition thereby maintaining the relay 64 in the unenergized state until a yarn breaks and a washer drops to short the strips 48 and 50 together. The transistor thereafter switches on to energize the relay 64 and opens a reset switch 70 in the circuit 68. The relay 64 has a normally open contact 64-1 in series with a warning light 72 and a normally closed contact 64-2 connected to the motor starter interlock circuit of the tufting machine or other yarn manipulating machine. When the relay 64 is energized the warning light 72 is energized to alert the operator and the motor circuit is deenergized to stop the machine. The operator may thereafter remove the washer or washers from the trough and repair the broken yarn end while inserting the yarn through the aperture in each washer prior to repairing the yarn. The motor or motors thereafter may be restarted and the switch 70 reset. Further details of the circuit is readily understood by those skilled in the electrical art and is not believed to be required for an understanding of the present invention.

Figure 4:
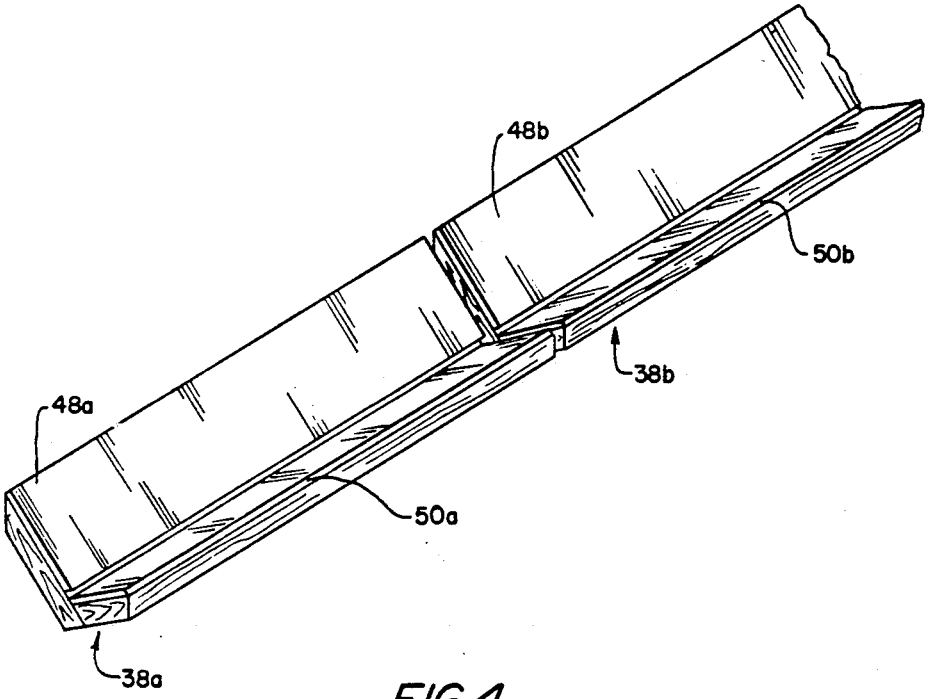
FIG. 4 is a perspective view of the strip contactor portion of the apparatus depicting a plurality of units mounted across a machine for ease in locating a broken yarn end.

As illustrated in FIG. 4, the detector of the present invention preferably is constructed in modular form so that a number of such detectors each corresponding to a group of yarns may detect broken yarns in that group. Thus, for a tufting machine of 12 meters there may be approximately four such detecting units each of approximately three meters so that when a yarn breaks and the machine stops, the indicator light 72 associated with the detector unit corresponding to the group of yarns that includes the broken yarn will illuminate and the operator can readily find the broken yarn and washers associated therewith. In FIG. 4, for purposes of illustration, two detectors **38*a* and 38*b* are illustrated, the strips 48*a* and 50*a* of the first detector unit being spaced from the strips 48*b* and 50*b* of the other detector so that each may be connected in a separate electrical circuit, or at least through a separate indicator light 72** for the above purpose.

Accordingly, a simple and inexpensive yarn break detector is disclosed which is substantially infallible in operation and when positioned remote from the needles or other yarn manipulating instrumentalities can stop the machine and minimize production of defective fabric. When combined with the apparatus of the aforesaid Beverly patent, production of defective fabric and thus mending operations are substantially nill.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed is:

1. A yarn break detector for detecting the occurrence of a yarn having a broken end at a location between a yarn supply and yarn manipulating instrumentalities of a machine to which said yarn end is fed, said detector comprising first and second electrically conducting plates, mounting means for mounting said plates below said yarn end at a location where the broken yarn is to be detected, each of said plates having an upper edge and a lower edge, said plates being disposed at a downward inclination relative to each other to form a substantially V-shape configuration therebetween with a small gap intermediate said lower edges and with said upper edges spaced apart to form a mouth therebetween, electrical circuit means including a source of electricity and indicator means connected to said plates and normally maintained open by said gap, and at least one electrically conductive member carried by said yarn above said plates for falling through said mouth and down toward said gap upon breakage of said yarn, said member being sized to short said plates together across said gap and close said circuit means to energize said indicator means irrespective of any disposition of said member after it has fallen.

2. A yarn break detector as recited in claim 1, wherein said member has a pair of spaced apart surfaces including an aperture extending through said surfaces and through which said yarn is threaded prior to breakage, said surfaces being spaced apart by a distance no smaller than said gap.

3. A yarn break detector as recited in claim 2, wherein said member is a metal washer.

4. A yarn break detector as recited in claim 1, wherein said circuit means includes means operatively connected to said machine for stopping said machine when said plates are shorted together.

5. A yarn break detector as recited in claim 1, wherein said plates are mounted in a trough comprising an insulated frame, and said plates are fastened to and supported by said frame.

6. In a motor driven textile machine having a multiplicity of yarn manipulating instrumentalities and a source of yarn for supplying a multiplicity of yarns to respective instrumentalities, a yarn break detector for detecting the occurrence of a yarn having a broken end at a location between said source and said instrumentalities and for stopping said machine so that said broken yarn end can be repaired, said detector comprising an elongated trough including first and second elongated electrically conducting plates, mounting means for mounting said plates below said yarns at the location where a broken yarn is to be detected, each of said plates having an upper edge and a lower edge, said plates being disposed at a downward inclination relative to each other to form a substantially V-shape configuration therebetween with a small gap intermediate said lower edges and with said upper edges spaced apart to form a mouth, electrical circuit means including a source of electricity, indicator means and motor deenergizing means connected to said plates and normally maintained open by said gap, and at least one electrically conductive member carried by each yarn above said trough for falling through said mouth and into said trough upon breakage of a yarn, each of said members being sized to short said plates together and close said circuit to energize said indicator means and activate said deenergizing means irrespective of any disposition of said member after it has fallen.

7. In a motor driven textile machine as recited in claim 6, wherein each of said members comprises a pair of spaced apart surfaces including an aperture extending through said surfaces and through which a respective yarn is threaded prior to breakage, said surfaces being spaced apart by a distance no smaller than said gap.

8. In a motor driven textile machine as recited in claim 7, wherein each of said members is a metal washer.

9. In a motor driven textile machine as recited in claim 6, wherein said trough comprises an insulated frame, and said plates are fastened to and supported by said frame intermediate said source and said machine.

10. In a motor driven textile machine as recited in claim 9, wherein said machine includes a plurality of detectors, each detector being disposed for detecting the broken yarn in a predetermined group of said yarns.

11. In a motor driven textile machine as recited in claim 6, wherein said circuit includes a relay having a coil connected in the circuit with said plates, a normally open contact connected to said indicator means and a normally closed contact connected to said motor, whereby when a member shorts said plates said normally open contact closes to energize said indicator means and said normally closed contact opens to deenergize said motor.

12. In a motor driven textile machine as recited in claim 6, wherein said machine includes a plurality of detectors, each detector being disposed for detecting the broken yarn in a predetermined group of said yarns.

13. In a tufting machine having a multiplicity of yarn carrying needles mounted laterally across said machine and reciprocably driven to penetrate a base material to insert loops of yarn therein, yarn guide means for guiding a yarn strand to each needle from a yarn supply, a yarn break detector intermediate said needles and said guide means for detecting a broken yarn, said detector comprising an elongated trough including first and second elongated electricity conducting plates, mounting means for mounting said plates below said yarns at a location where the broken yarn is to be detected, each of said plates having an upper edge and a lower edge, said plates being disposed at a downward inclination relative to each other to form a substantially V-shaped configuration therebetween with a small ga intermediate said lower edges and with said upper edges spaced apart to form a mouth, electrical circuit means including signal generating means and machine deenergizing means connected to said plates and normally maintained open by said gap, and at least one electrically conductive member carried by each yarn above said trough for falling through said mouth into said trough upon breakage of the yarn, each of said members being sized to short said plates together and close said circuit to energize said signal generating means and stop said machine irrespective of any disposition of the member after it has fallen.

14. In a tufting machine as recited in claim 13, wherein each of said members has a pair of spaced apart surfaces including an aperture extending through said surfaces and through which said yarn is threaded prior to breakage, said surfaces being spaced apart by a distance no smaller than said gap.

15. In a tufting machine as recited in claim 14, wherein each of said members is a metal washer.

16. In a tufting machine as recited in claim 13, wherein said machine includes plurality of detectors, each detector being disposed for detecting a broken yarn in a predetermined group of said yarns.

17. In a tufting machine as recited in claim 12, wherein said trough comprises an insulated frame, and said plates are fastened to and supported by said frame, and means for connecting said frame to said tufting machine.

18. In a tufting machine as recited in claim 13, wherein said machine includes a plurality of detectors, each detector being disposed for detecting the broken yarn in a predetermined group of said yarns.

* * * * *